United States Patent [19]

Nichols et al.

[11] 4,143,576

[45] Mar. 13, 1979

[54] CAPO

[76] Inventors: Joseph C. Nichols, 2252 Goodrich Ave., St. Paul, Minn. 55105; John M. Berner, 3344 Harriet Ave., Minneapolis, Minn. 55408; Mario F. Fernandez, 721 Kenwood Pkwy., Minneapolis, Minn. 55403

[21] Appl. No.: 786,113

[22] Filed: Apr. 11, 1977

[51] Int. Cl.[2] ..... G10D 3/04

[52] U.S. Cl. ..... 84/318

[58] Field of Search ..... 84/318

[56] References Cited

U.S. PATENT DOCUMENTS 620,560 3/1899 Averitt ..... 84/318

FOREIGN PATENT DOCUMENTS 382448 10/1923 Fed. Rep. of Germany ..... 84/318
1208164 12/1965 Fed. Rep. of Germany ..... 84/318
1376533 9/1964 France ..... 84/318

*Primary Examiner*—Lawrence R. Franklin

[57] ABSTRACT

A fretted neck of a guitar having a plurality of strings spaced above the fretboard and a capo selectively movable along the length of the neck for retaining all of the strings in abutting relationship to the fretboard. The capo includes a clamp frame having a generally horizontally extending portion that mounts a retainer bar and a generally vertically extending portion, a finger operated clamp member, and a torsion spring mounting the clamp member on the clamp frame and resiliently urging it to a clamping position, and the torsion spring being mounted on the clamp frame. In one embodiment the retainer bar mounts a roller for each string while in a second embodiment the retainer bar mounts rollers with one of the rollers being of a length to extend across two strings. In a third embodiment the retainer bar mounts two plastic inserts that have downwardly extending rectangular teeth for holding the guitar strings against the fretboard.

9 Claims, 7 Drawing Figures

FIG. 1
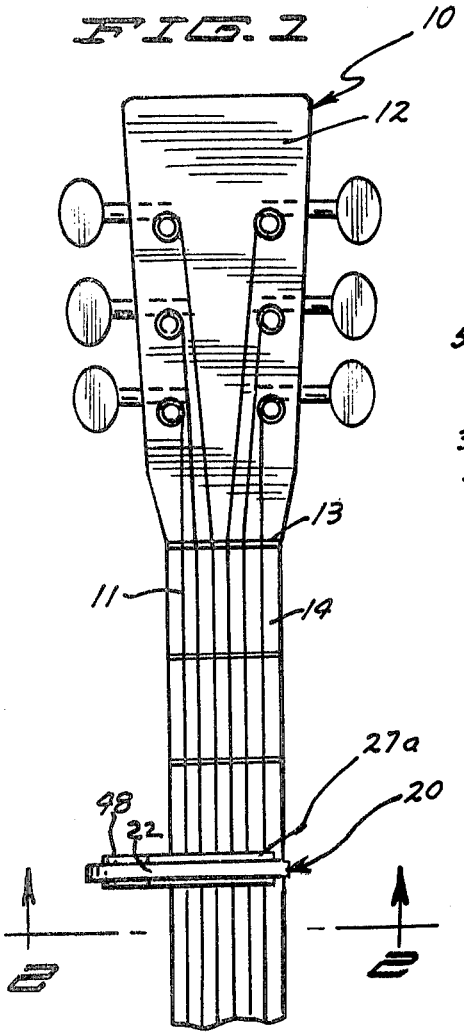
FIG. 2
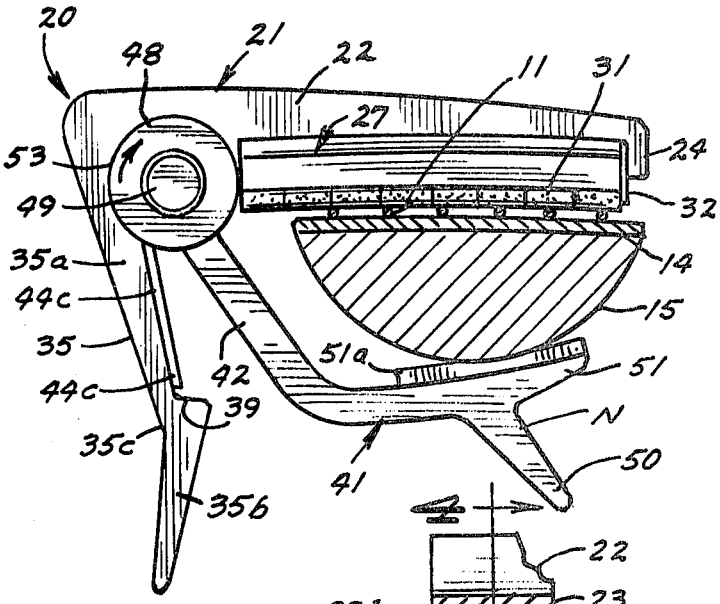
FIG. 3
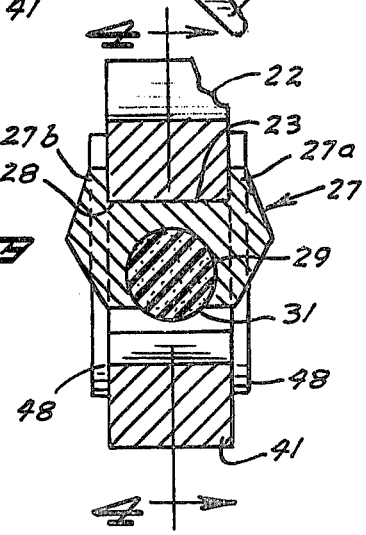
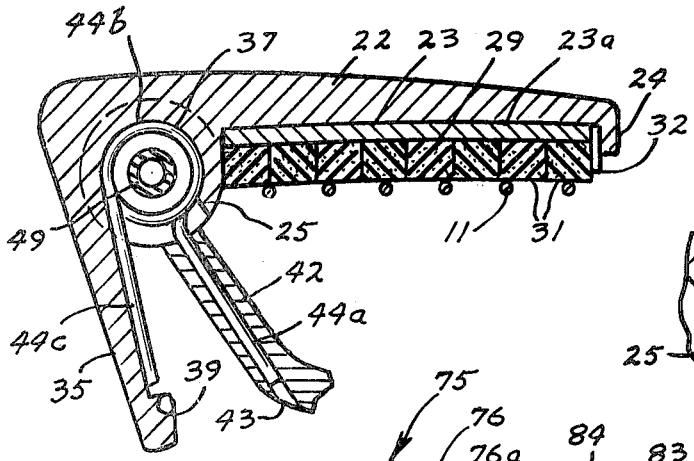
FIG. 4
FIG. 5
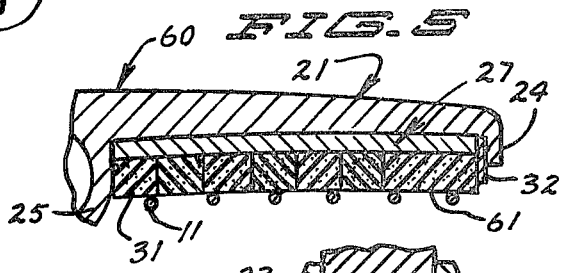
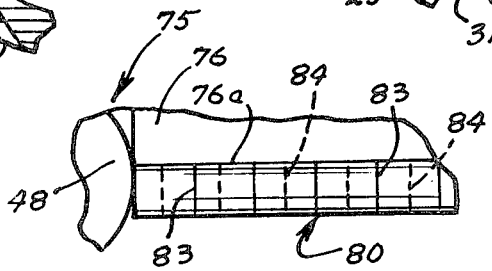
FIG. 7
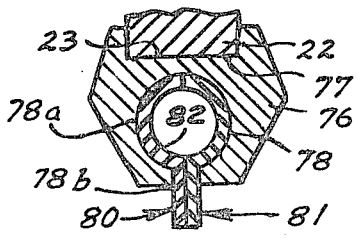
FIG. 6

CAPO

BACKGROUND OF THE INVENTION

A capo for a guitar.

In the prior art it is old to provide capos mountable on a guitar neck to change the pitch of all strings without having to retune the guitar, for example, see German Utility Model (DBGM) No. 7,224,424. However such prior art capos may not be readily adjustably moved along the length of the neck from one playing position to another with one hand. Also some prior art capos get in the way of the hand (left hand) that is playing the finger board of the guitar. In order to overcome problems such as the above, as well as others, this invention has been made.

SUMMARY OF THE INVENTION

A capo for a guitar that includes a clamp frame that has a horizontal portion extendable across the strings of the guitar and vertically extending leg, string engaging mechanism mounted by the horizontal portion for holding the strings in engagement with the fretboard of the guitar, and a clamp member resiliently mounted on the clamp frame that is resiliently urged to clampingly engage the guitar neck.

One of the objects of the invention is to provide a new and novel capo that may be readily moved from one clamped position on the guitar neck to another clamped position on the neck with one hand, and may be attached or removed from the guitar neck with one hand. Another object of the invention is to provide a new and novel capo that will relatively tightly hold the strings of a guitar against the fretboard but at the same time permit the strings moving thereunder when tuning the guitar.

A further object of the invention is to provide in a capo, a new and novel mounting of a clamp member on a clamp frame. An additional object of this invention is to provide in a capo, new and novel mechanism engagable with strings of a guitar to hold the strings against the fretboard.

BRIEF DESCRIPTION OF THE DRAWINGS

FIG. 1 is a fragmentary plan view of a guitar neck portion and the apparatus of this invention;

FIG. 2 is a longitudinal cross sectional view of the guitar neck generally taken along the line and in the direction of the arrows 2—2 of FIG. 1 that shows a side view of the first embodiment of the apparatus of this invention in a clamped condition on the neck;

FIG. 3 is a fragmentary transverse cross sectional view of the first embodiment apparatus of this invention that more clearly show the mounting of the rollers on the clamp frame;

FIG. 4 is a longitudinal cross sectional view generally taken along the line and in the direction of the arrows 4—4 of FIG. 3;

FIG. 5 is a fragmentary longitudinal cross sectional view of the second embodiment of the invention;

FIG. 6 is a fragmentary transverse cross sectional view of a third embodiment of the invention;

FIG. 7 is a fragmentary, longitudinal side view of the third embodiment of the invention.

Referring now to FIGS. 1–4, there is shown the neck portion of a guitar, generally designated 10, that includes a plurality of strings 11 secured to the head 12 and extended over the nut 13 to be normally retained a distance from the fretboard 14 on the neck 15. The first embodiment of the capo of this invention, generally designated 20, includes a capo clamp frame, generally designated 21, that has a horizontally elongated frame portion 22. The frame portion 22 has a longitudinally elongated, downwardly facing notch 23 that at one end is in part defined by a leg 24 and at the opposite end part by a curved leg 25. The longitudinally elongated wall portion 23*a* that in part defines notch 23 is slightly arcuately curved along the length thereof about an axis that extends transverse to the direction of elongation of horizontal portion 22 and below the horizontal portion.

Mounted by the horizontal portion 22 is a longitudinally elongated roller retainer, generally designated 27, that is of a length to extend nearly the entire length of the notch 23. The retainer has a top slot 28 that extends the length thereof to define upwardly extending legs 27*a*, 27*b* respectively. The adjacent surfaces of legs 27*a*, 27*b* are slightly inclined inwardly toward one another to form a pressed fit with the adjacent sides of horizontal portion 22. The height of the retainer is greater than that of notch 23. The retainer is provided with a downwardly opening recess 29 that extends the length thereof, the wall defining the recess extending arcuately through an angle substantially greater than 180°. Additionally, the slot 28 and recess 29 along the length thereof are curved about radii of curvature slightly smaller than the radii of curvature of the frame wall 23*a*.

A plurality of generally cylindrical rollers 31, advantageously made of plastic, are mounted in the recess 29, the rollers being of diameters to form a close rolling fit with the wall defining recess 29. A spring clip 32 is extended into notch 23 between the retainer 27 and leg 24 to be held in position thereby, the spring clip extending downwardly along one end of the adjacent roller for urging the roller against which it abuts toward the curved leg 25 whereby the rollers are retained in an end to end abutting relationship. The spring clip retaining the rollers in end to end abutting relationship functions to prevent the guitar string moving to a position to be located between adjacent pairs of rollers, i.e. preventing the rollers axially moving apart sufficiently to provide a gap into which a guitar string can move.

The clamp frame includes a generally vertically extending portion 35 that extends downwardly from the horizontal portion at the end thereof remote from leg 24. The vertical portion 35 includes an upper part 35*a* that is inclined downwardly and in a direction toward leg 24. Portion 35*a* and leg 25 in part defined a recess 37 that has a cylindrical portion extended arcuately through an angle greater than 180° about an axis transverse to the direction of elongation of the horizontal portion 22. The upper part 35*a* is joined to the upper end of lower part 35*b* to form a shoulder 39 that faces recess 37. Part 35*b* extends substantially vertically downwardly whereby parts 35*a*, 35*b* provide a wide angle V-shaped surface 35*c*.

A clamp member, generally designated 41, has a leg 42 that is provided with a hole 43 that extends through at least a substantial part of the length thereof. A torsion spring 44 has a leg 44*a* that is extended into the hole 43 for mounting the clamp member, a loop 44*b* that extends through an arcuate angle of more than 360°, and a leg 44*c* that is abuttable against portion 35*a*. When the loop part 44*b* is mounted in the recess 37, the radius of curvature of the curved part recess 37 and the outer diameter of loop portion 44*b* are of relative dimensions that the torsion spring is not movable downwardly out of the recess. To prevent the torsion spring moving sideways out of the recess, there are provided washers 48, one on either side of the clamp member, that are retained in abutting relationship to the clamp member by a rivet 49 that is extended through the loop portion of the torsion ring and recess 37.

The clamp member 41 also includes a leg 51 that is joined to leg 42 to provide a generally V-shaped notch that opens toward the slot 23. The end of leg 51 remote from leg 42 is of only a slightly smaller straight line spacing from rivet 49 than the spacing of leg 24 from said rivet. Joined to the mid under surface portion of leg 51 is a finger lever 50 which extends downwardly and in a direction to be progressively more remote from each of vertical portion 35 and horizontal portion 22.

Referring to FIG. 5, the second embodiment of the invention, generally designated 60, is of the same construction as that of the first embodiment, other than instead of 8 rollers, there is provided with 6 rollers 31, and a roller 61 that is of approximately twice the axial length of each roller 31. The roller 61 is located in a position to bear against the two strings (strings 5 and 6) of the guitar, which are made of relatively smooth wire. There is provided a separate roller for each of the other four strings since the other four wires have substantially roughened surfaces which will not relatively easily slide beneath the rollers.

In using the apparatus of this invention, the capo is grasped by hand such that the frame part **35*b* bears against the palm, part 35*a* extends upwardly between the juncture of the thumb and forefinger (or just the thumb bears against part 35*b*) and the lever 50 is located such that the outer end portion of the forefinger is extended in a generally V-shaped notch or saddle formed by the juncture of clamp leg 51 and lever 50. The forefinger exerts a pressure against lever 50 to pivot the lever toward part 35*b*, i.e. pivot the legs 51, 42 in the direction of the arrow 53 about the central axis of the rivet 49 whereby the outer end of leg 51 is moved away from the clamp frame horizontal portion 22 to provide a greater gap therebetween. The capo is moved such that the entire neck passes through said gap and abuts against leg 42 with the retainer bar 27 extending above the strings. Now the manual pressure on lever 50 is released and the torsion spring moves the clamp member to bring the clamp member leg 51 (or pad 51*a* if such a pad is provided) into abutting engagement with the neck and the rollers into abutting engagement with the strings to force the strings downward into engagement with the fretboard. Due to the angular relationship of the legs 42, 51 and the curvature of the neck, the clamp member in moving to a clamping position acts to properly position the rollers relative the strings; and to prevent the capo from sliding off the neck while the spring clip retains the rollers in abutting relationship to prevent one of the strings forcing the rollers to axially separate and move into the new resulting gap between the rollers. When it is desired to reposition the capo along the length of the neck, or to remove the capo from the neck, the capo is again grasped in the manner previously described and finger pressure exerted against lever 50** to pivot the clamp member to a release position.

Due to the provision of the rollers, one or more of the strings of the guitar may be tuned since for example, as one of the strings is tightened, the movement of the string will cause the roller to rotate while the roller holds the string against the fretboard.

Due to the configuration of the capo, it does not interfere with the playing of difficult chords, for example, the playing of the "B#7" chord.

In place of using a spring clip, the leg 24 may be made to extend further downwardly and a set screw threaded through the thus extended leg to bear against the cylindral part of adjacent roller to retain the rollers in an abutting relationship.

Referring to FIGS. 6 and 7, the third embodiment of the invention, generally designated 75, is of the same construction as the first embodiment other than for the retainer and the string engaging device. That is, the retainer 76 of the third embodiment has an upwardly opening slot 77 that extends the length thereof to provide legs that are in press fitting relationship to clamp frame portion 22. The retainer has a wall portion defining a downwardly opening recess 78 that extends the length thereof. The upper part **78*a* of the recess is of a cylindrical shape while the lower part 78*b*** is of a rectangular box shape to open directly to the cylindrical portion. The transverse width of the rectangular portion is many times smaller than the diameter of the cylindrical portion.

Mounted in the recess 78 are two string engaging plastic inserts, generally designated 80 and 81 respectively, that each is of substantially the same length as the recess. Each insert has a upper, half cylindrical tubular portion 82 and a lower rectangular portion that is integrally joined to the lower part of portion 82 to extend radially away therefrom. The outer radii of curvature of portions 82 are such that the cylindrical portions form a close fit with recess wall portion **78*a* while the insert rectangular portions are of thicknesses to form a close fit with recess wall portions 78*b***.

Insert 80 has a plurality of longitudinally spaced vertical slits 83 in its rectangular portion that extend from closely adjacent the lower surface **76*a* of the retainer through the lower terminal edge of the rectangular portion which is substantially spaced from the retainer. The slits 83 provide a plurality of separate rectangular teeth. Similarly insert 81 is provided with a plurality of slits 84 that are longitudinally offset from slits 83**. Due to the offsetting of the slits, the strings of the guitar are prevented from moving upwardly into one of the slits.

The inserts are of sufficient rigidity that when the capo is in its clamped position the lower terminal edges of the inserts will bear against strings to hold all of the strings against the fretboard when the capo is in its clamped position on the guitar neck.

As an example of the invention for certain types of guitars, the radius of curvature of wall portion that extends between legs 24, 25 and in part defines notch 23 may be about 15 inches while the longitudinal length of the notch may be about 2 inches. For other types, for example "classic" guitars wall portion **23*a*** is planar and the retainer is not arcuately curved along its length.

What is claimed is:

1. A capo mountable on the neck of a guitar to press the strings of the guitar against the guitar fretboard comprising a roller for engaging a string of a guitar, clamp means for mounting the roller, the clamp means including a horizontally elongated portion that has a horizontally elongated, downwardly opening notch and transversely opposite side portions extending above the notch, and a retainer member having a recess, a clamp member mounted on the clamp means for clampingly engaging the guitar neck, the retainer member being mounted on the horizontal portion to extend between the horizontal portion and the clamp member, the retainer member having transversely spaced, upwardly extending legs, the retainer member being extended into the notch to have its legs abut against the transversely opposite side portions of the horizontal portion and the recess open toward the clamp member, said roller being rotatably mounted in the recess to extend outwardly of the recess toward the clamp member.

2. A capo mountable on the neck of a guitar to press all the strings of the guitar against the guitar fretboard comprising a clamp frame, means mounted on the frame for engaging guitar strings to press the strings against the fretboard, clamp means for resiliently engaging the guitar neck to retain the clamp frame in a preselected position on the neck, said clamp means being mounted on the clamp frame for movement relative thereto between a neck clamping position and a nonclamping position, said clamp means having a finger engageable lever portion that extends away from the string engaging means and having a terminal end remote from the string engaging means, said clamp frame having a hand engageable portion remote from both said terminal end and the string engaging means that extends generally away from the string engaging means in about the same general direction the lever portion extends away from the string engaging means, the string engaging means including a retainer bar mounted on the clamp frame and having an elongated recess that along its length opens toward the clamp means, and a plurality of rollers rotatably mounted in the recess, said rollers extending outwardly of the recess toward the clamp means.

3. A capo mountable on the neck of a guitar to press all the strings of the guitar against the guitar fretboard comprising a clamp frame that includes a horizontally elongated portion having a first end portion, a second end portion, and an intermediate portion, guitar string engageable mechanism mounted by the intermediate portion, a generally vertically extending portion dependingly joined to the second end portion, a clamp member having a first end portion and a second end portion, and means mounted on the clamp frame adjacent the horizontal portion second end portion and acting against the frame and the clamp member second end portion for resiliently urging the clamp member first end portion toward the horizontal portion, the resilient urging means comprising a torsion spring having a looped portion, a first leg in abutting relationship to the vertically extending portion, and a second leg mounting the clamp member second end portion, the legs being joined to the looped portion in spaced relationship to one another.

4. The apparatus of claim 3 further characterized in that the frame has a downwardly opening recess adjacent the juncture of its horizontal and vertically extending portions, said looped portion being located in said recess.

5. The apparatus of claim 4 further characterized in that there is provided means extended through the looped portion and abutting against the clamp frame to retain the looped portion in the recess.

6. A capo mountable on the neck of a guitar to press all the strings of the guitar against the guitar fretboard comprising a clamp frame that includes a horizontally elongated portion having a first end portion, a second end portion, and an intermediate portion, guitar string engageable mechanism mounted by the intermediate portion, a generally vertically extending portion dependingly joined to the second end portion, a clamp member having a first end portion and a second end portion, and means mounted on the clamp frame adjacent the horizontal portion second end portion and acting against the frame and the clamp member second end portion for resiliently urging the clamp member first end portion toward the horizontal portion, the string engaging means comprising an elongated retainer member mounted on the clamp frame to extend between the clamp frame and the clamp member, the retainer member having a recess opening toward the clamp member, and at least one string engageable member mounted in the retainer recess to extend more closely adjacent the clamp member than does the retainer member, the horizontally elongated portion having a horizontally elongated, downwardly opening notch, and transversely opposite side portions extending above the notch, and the retainer member having transversely spaced, upwardly extending legs extending the length thereof to define a groove, the retainer member being extended into the notch to have its legs abut against the horizontal portion transversely opposite side portions.

7. A capo mountable on the neck of a guitar to press all the strings of the guitar against the guitar fretboard comprising a clamp frame that includes a horizontally elongated portion having a first end portion, a second end portion, and an intermediate portion, guitar string engageable mechanism mounted by the intermediate portion, a generally vertically extending portion dependingly joined to the second end portion, a clamp member having a first end portion and a second end portion, and means mounted on the clamp frame adjacent the horizontal portion second end portion and acting against the frame and the clamp member second end portion for resiliently urging the clamp member first end portion toward the horizontal portion, the string engaging means comprising an elongated retainer member mounted on the clamp frame to extend between the clamp frame and the clamp member, the retainer member having a recess opening toward the clamp member, and at least one string engageable member mounted in the retainer recess to extend more closely adjacent the clamp member than does the retainer member, the engageable member comprising a roller rotatably mounted in the retainer recess.

8. A capo mountable on the neck of a guitar to press all the strings of the guitar against the guitar fretboard comprising a clamp frame that includes a horizontally elongated portion having a first end portion, a second end portion, and an intermediate portion, guitar string engageable mechanism mounted by the intermediate portion, a generally vertically extending portion dependingly joined to the second end portion, a clamp member having a first end portion and a second end portion, and means mounted on the clamp frame adjacent the horizontal portion second end portion and acting against the frame and the clamp member second end portion for resiliently urging the clamp member first end portion toward the horizontal portion, the string engaging means comprising an elongated retainer member mounted on the clamp frame to extend between the clamp frame and the clamp member, the retainer member having a recess opening toward the clamp member, and at least four string engageable members mounted in the retainer recess to extend more closely adjacent the clamp member than does the retainer member, the string engageable members comprising rollers mounted in the retainer recess in end to end relationship for rotation independent of one another.

9. The apparatus of claim 8 further characterized in that there is provided means on the frame for retaining the rollers in end to end abutting relationship.

* * * * *